US011207903B2

(12) United States Patent
Waki

(10) Patent No.: US 11,207,903 B2
(45) Date of Patent: Dec. 28, 2021

(54) MEDIUM TRANSPORT DEVICE AND RECORDING APPARATUS

(71) Applicant: SEIKO EPSON CORPORATION, Tokyo (JP)

(72) Inventor: Shingo Waki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/083,746

(22) Filed: Oct. 29, 2020

(65) Prior Publication Data

US 2021/0129555 A1 May 6, 2021

(30) Foreign Application Priority Data

Oct. 31, 2019 (JP) ..... JP2019-198384

(51) Int. Cl.
*B41J 13/02* (2006.01)
*B41J 11/00* (2006.01)
*B41J 11/04* (2006.01)

(52) U.S. Cl.
CPC ..... *B41J 11/007* (2013.01); *B41J 11/04* (2013.01)

(58) Field of Classification Search
CPC . B41J 13/02; B41J 11/007; B41J 11/04; B41J 3/60; B65H 5/00
See application file for complete search history.

(56) References Cited

U.S. PATENT DOCUMENTS

2002/0021343 A1 2/2002 Uchida
2004/0091283 A1 5/2004 Nobe et al.
2007/0146419 A1* 6/2007 Samoto ..... B41J 19/005 347/37
2008/0205954 A1* 8/2008 Sugiyama ..... B41J 13/009 399/401
2008/0240823 A1* 10/2008 Asada ..... B65H 3/0684 399/401
2009/0035044 A1 2/2009 Yoshioka
2011/0195828 A1* 8/2011 Taketsugu ..... B41J 13/025 492/28
2013/0256976 A1* 10/2013 Samoto ..... B65H 29/125 271/10.11
2014/0063108 A1* 3/2014 Iijima ..... B41J 13/0009 347/16

(Continued)

FOREIGN PATENT DOCUMENTS

JP 2002-103736 A 4/2002
JP 2004-042382 A 2/2004

(Continued)

*Primary Examiner* — Huan H Tran
(74) *Attorney, Agent, or Firm* — Workman Nydegger

(57) ABSTRACT

A medium transport device includes a first roller that applies a transporting force to a medium, a second roller that applies a transporting force to the medium transported from the first roller, a third roller that applies a transporting force to the medium transported from the second roller, a first rotor that transmits rotational torque to the third roller, a first shaft that is provided away from the first rotor at a first interval, and a second shaft that is provided away from the first rotor at the first interval and at a position different from a position of the first shaft. A shaft center of the first shaft and a shaft center of the second shaft are positioned on a circular arc, the center of which is a rotation center of the second roller.

8 Claims, 9 Drawing Sheets

(56) References Cited

U.S. PATENT DOCUMENTS

| | | | | |
|---|---|---|---|---|
| 2016/0089901 | A1* | 3/2016 | Sano | B41J 3/60<br>347/104 |
| 2017/0087877 | A1* | 3/2017 | Nishimura | B41J 17/02 |

FOREIGN PATENT DOCUMENTS

| | | | |
|---|---|---|---|
| JP | 2004-154974 | A | 6/2004 |
| JP | 2008-200892 | A | 9/2008 |
| JP | 2009-034858 | A | 2/2009 |

* cited by examiner

MEDIUM TRANSPORT DEVICE AND RECORDING APPARATUS

The present application is based on, and claims priority from JP Application Serial Number 2019-198384, filed Oct. 31, 2019, the disclosure of which is hereby incorporated by reference herein in its entirety.

BACKGROUND

1. Technical Field

The present disclosure relates to a medium transport device that transports a medium, and a recording apparatus including the medium transport device.

2. Related Art

Recording apparatuses represented by a facsimile machine, a printer, and the like may have a lineup of, from a strategic sales point of view, a plurality of models having specifications that are substantially the same but partially differ from each other. Since designing dedicated parts for each model causes an increase in costs, common parts have been used as much as possible in the related art (see JP-A-2002-103736, JP-A-2004-154974, JP-A-2004-042382, JP-A-2008-200892, and JP-A-2009-034858).

Also for a medium transport device that transports a medium, there has been a demand for using common parts as much as possible for a model including a single motor as a driving source that drives a plurality of rollers and for a model including a plurality of motors. However, when the number of motors is changed, particularly, in a transmission mechanism that transmits a driving force from a motor to a roller, the number of dedicated parts to be prepared for each model is easily increased, which inhibits a reduction in costs.

SUMMARY

According to an aspect of the present disclosure, a medium transport device includes a first roller that applies a transporting force to a medium, a second roller that applies a transporting force to the medium transported from the first roller, a third roller that applies a transporting force to the medium transported from the second roller, a third roller driving gear that transmits rotational torque to the third roller, a first shaft that is provided away from the third roller driving gear at a first interval, and a second shaft that is provided away from the third roller driving gear at the first interval and at a position different from a position of the first shaft, in which a shaft center of the first shaft and a shaft center of the second shaft are positioned on a circular arc, a center of which is a rotation center of the second roller.

DESCRIPTION OF EXEMPLARY EMBODIMENTS

Figure 1:
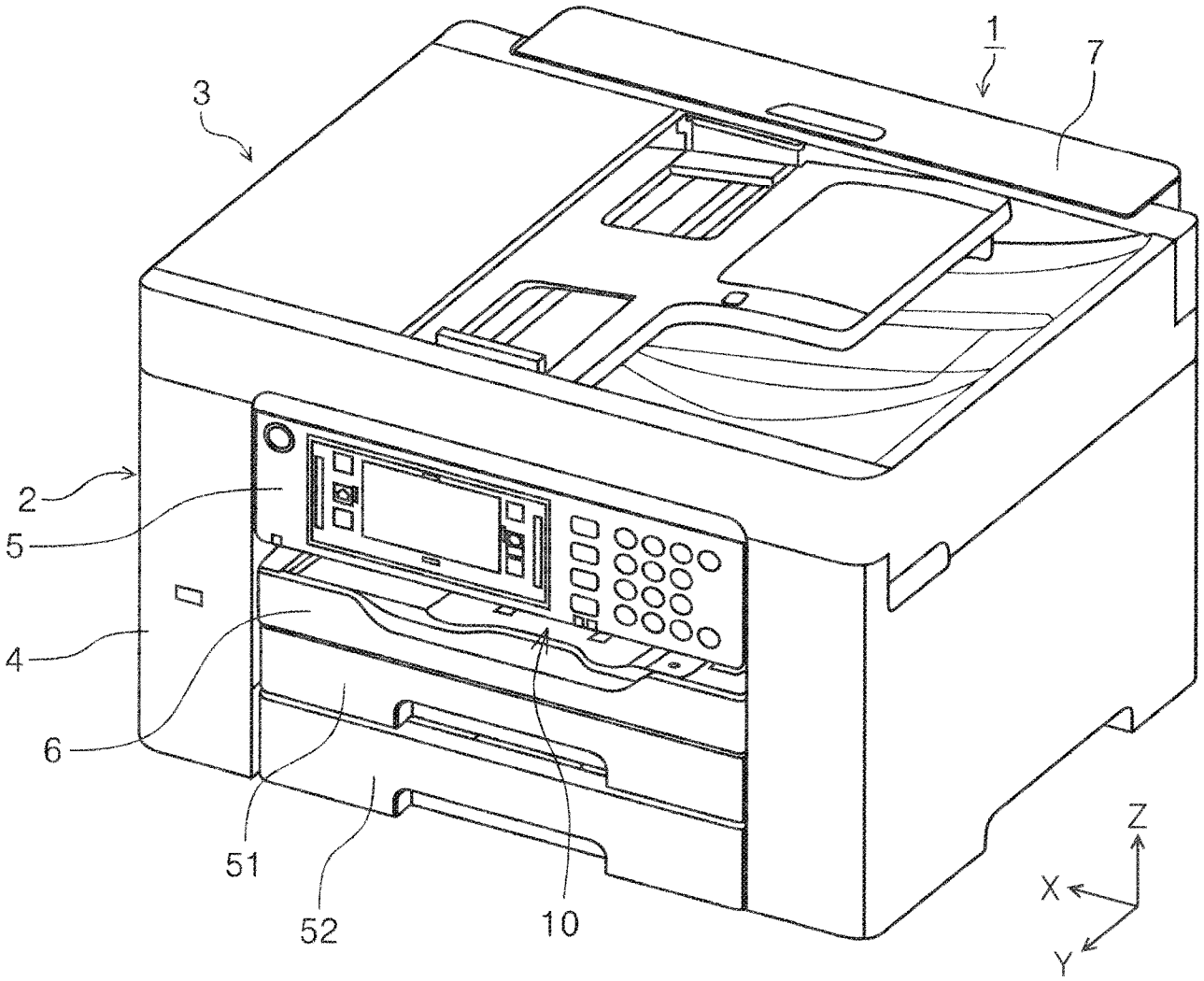
FIG. 1 is a front perspective view of a printer.

Hereinafter, the present disclosure will be schematically described.

A medium transport device according to a first aspect includes: a first roller that applies a transporting force to a medium; a second roller that applies a transporting force to the medium transported from the first roller; a third roller that applies a transporting force to the medium transported from the second roller; a first rotor that transmits rotational torque to the third roller; a first shaft that is provided away from the first rotor at a first interval; and a second shaft that is provided away from the first rotor at the first interval and at a position different from a position of the first shaft, in which a shaft center of the first shaft and a shaft center of the second shaft are positioned on a circular arc, a center of which is a rotation center of the second roller.

According to the aspect, in the medium transport device including the first roller, the second roller, and the third roller, the first shaft and the second shaft are disposed for the first rotor that transmits rotational torque to the third roller, and thus a driving force transmission configuration can vary between when using the first shaft and when using the second shaft.

Further, the first shaft and the second shaft are disposed on the circular arc, the center of which is the rotation center of the second roller, and thus a distance between the rotation center of the second roller and the first shaft, and a distance between the rotation center of the second roller and the second shaft are kept constant. In addition, both an interval between the first shaft and the first rotor and an interval between the second shaft and the first rotor are set to the first interval.

As a result, the same component configuration can be used for the driving force transmission mechanism using a belt, a gear, or the like both the time when transmitting a driving force between the first rotor and the second roller by using the first shaft and the time when transmitting a driving force between the first rotor and the second roller by using the second shaft, such that it is possible to effectively suppress an increase in costs when developing models with different specifications.

According to a second aspect, the medium transport device according to the first aspect further includes: a second rotor that is provided on a rotation shaft of the second roller and applies rotational torque to the second roller; a belt that is wound on a third rotor provided on the first shaft or the second shaft and wound on the second rotor; a tension applying member that applies tension to the belt; a slider that supports the tension applying member and is configured to slide in a direction to advance and retreat with respect to the belt; and a pressing member that applies a pressing force to the slider, in which a first guide groove that guides the slider, and a second guide groove that extends in a direction intersecting a direction in which the first guide groove extends and that guides the slider are provided in a frame supporting the rotation shaft of the second roller.

According to the aspect, the first guide groove that guides the slider and the second guide groove that extends in the direction intersecting the direction in which the first guide groove extends and that guides the slider are provided. Therefore, it is possible to apply, in an appropriate direction, tension to the belt when the rotor is provided on the first axis and to the belt when the rotor is provided on the second shaft without increasing costs.

According to a third aspect, in the medium transport device according to the second aspect, at least one of the first shaft or the second shaft is integrated with the frame.

According to the aspect, at least one of the first shaft or the second shaft is integrated with the frame, and thus it is possible to reduce costs of the apparatus.

A recording apparatus according to a fourth aspect includes a recording unit that performs recording on a medium, and the medium transport device according to any one of first to third aspects.

According to the aspect, in the recording apparatus, effects of any of the first to third aspects can be obtained.

A recording apparatus according to a fifth aspect includes: a recording unit that performs recording on a medium; and the medium transport device according to the second or third aspect, in which the medium transport device includes: a first medium transport path which is a medium transport path facing the recording unit and is configured to transport the medium in a first direction which is a medium transport direction when performing the recording on the medium and in a second direction opposite to the first direction; a reverse path configured to reverse the medium; a second medium transport path configured to guide, to the reverse path, the medium subjected to the recording by the recording unit; and a third medium transport path which is positioned vertically below the second medium transport path, guides, to the reverse path, the medium subjected to the recording by the recording unit, and differs from the second medium transport path, the first roller is provided downstream of the recording unit on the first medium transport path and transports the medium in the first direction, the second roller is positioned downstream of the first roller in the first direction and is configured to rotate in a normal rotation direction to transport the medium transported in the first direction to a discharge port and in a reverse rotation direction opposite to the normal rotation direction, the medium being discharged from the discharge port by normal rotation of the second roller and the medium being transported to the third medium transport path by reverse rotation of the second roller, and the third roller is provided on the third medium transport path and is configured to rotate only in a normal rotation direction to transport the medium to the reverse path.

According to the aspect, it is possible to ensure, by using the third medium transport path, a path length when transporting the medium to the reverse path and facilitate double-sided recording on a long medium.

According to a sixth aspect, in the recording apparatus according to the fifth aspect, the first shaft is a rotation shaft of the first roller, the third rotor is provided on the first shaft, a first gear that meshes with a third roller driving gear as the first rotor is integrated with the third rotor, and the second roller and the third roller are driven by a first motor through the rotation shaft of the first roller.

According to the aspect, the first roller, the second roller, and the third roller can be driven by the first motor, and it is possible to reduce parts costs of the apparatus.

According to a seventh aspect, in the recording apparatus according to the fifth aspect, the first shaft is a rotation shaft of the first roller, the third rotor is provided on the second shaft, a first gear that meshes with a third roller driving gear as the first rotor is integrated with the third rotor, the first roller is driven by a first motor, and the second roller and the third roller are driven by a second motor through the first gear.

According to the aspect, the first roller is driven by the first motor, and the second roller and the third roller are driven by the second motor. Therefore, it is possible to increase a degree of freedom in control.

According to an eighth aspect, the recording apparatus according to the seventh aspect further includes a motor attaching member to which the second motor is attached, in which a shaft end of the second shaft is supported by the motor attaching member in a state in which the motor attaching member is fixed to the frame.

According to the aspect, the shaft end of the second shaft is supported by the motor attaching member in a state in which the motor attaching member is fixed to the frame, and thus it is possible to suppress deformation of the second shaft.

Hereinafter, the present disclosure will be described in detail.

In each drawing, a direction along an X-axis is an apparatus width direction and is a direction intersecting a sheet transport direction, that is, a sheet width direction. A −X direction is a rightward direction when viewed by a user facing a front surface of the apparatus, and a +X direction is a leftward direction.

Further, a direction along a Y-axis is an apparatus depth direction, and a +Y direction is a direction from a rear surface of the apparatus toward the front surface and is referred to as a first direction. Further, a −Y direction is a direction from the front surface of the apparatus toward the rear surface and is referred to as a second direction.

Further, a direction along a Z axis is a vertical direction, a +Z direction is a vertically upward direction, and a −Z direction is a vertically downward direction.

In the present embodiment, among side surfaces of the apparatus, a side surface on which an operating section 5 is provided is the front surface of the apparatus.

In FIG. 1, an ink jet printer 1, which is an example of the recording apparatus, is a multifunction peripheral including a scanner section 3 that is provided on upper side of an apparatus body 2. Hereinafter, the ink jet printer is simply referred to as a "printer".

The apparatus body 2 has a function of performing recording on a recording sheet, which is an example of the medium, and the scanner section 3 has a function of reading a document. Further, the scanner section 3 includes an auto document feeder (ADF) that automatically feeds a set document.

The apparatus body 2 includes a medium transport device 4 (see FIG. 2) that transports a recording sheet, a transport path (to be described later) through which the recording sheet is transported, and a recording head 9 (see FIG. 2) which is an example of the recording unit. In addition, in the present embodiment, two medium housing cassettes, specifically, a first sheet cassette 51 and a second sheet cassette 52, are detachably provided.

Further, the apparatus body 2 is configured also to set and feed a sheet from the rear surface of the apparatus in addition to setting sheet in the first sheet cassette 51 and the second sheet cassette 52. A cover 7 opens/closes a sheet setting port (not illustrated) at the time of setting a sheet from the rear surface of the apparatus.

The apparatus body 2 includes the operating section 5 that is provided on the front surface of the apparatus and used to perform various operations of the printer 1. The operating section 5 includes a display section and a plurality of operation buttons and is provided to be tiltable.

A discharge port 10 through which a recording sheet subjected to recording is discharged is provided below the operating section 5, and a discharge tray 6 that receives the discharged recording sheet is provided on a lower side of the discharge port 10. The discharge tray 6 can be in a state of being housed in the apparatus body 2 as illustrated in FIG. 1 and a state of being drawn out from the apparatus body 2 (not illustrated).

Figure 2:
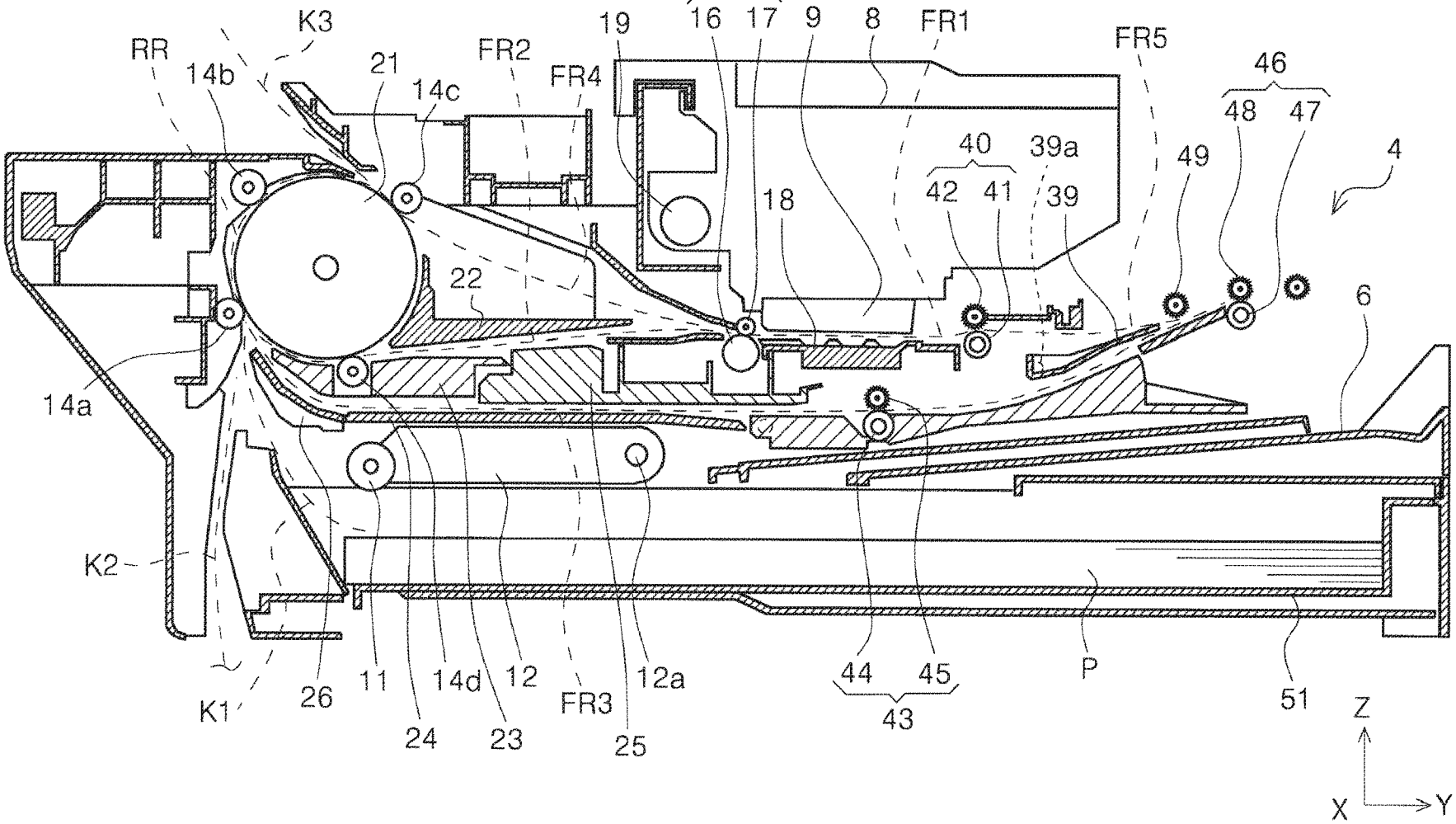
FIG. 2 is a side sectional view illustrating an entire sheet transport path of the printer.

Next, the transport path for the recording sheet will be described with reference to FIG. 2. Note that the second sheet cassette 52 is not illustrated in FIG. 2.

In the printer 1, the recording sheet is transported to a transport roller pair 15 via a reverse roller 21 constituting a reverse path RR irrespective of a feeding path and is transported by the transport roller pair 15 to a region where recording is performed by the recording head 9.

More specifically, the printer 1 includes, as sheet feeding paths, a sheet feeding path K1 for feeding a recording sheet from the first sheet cassette 51, a sheet feeding path K2 for feeding a recording sheet from the second sheet cassette 52 that is positioned under the first sheet cassette 51, and a sheet feeding path K3 for manually feeding a recording sheet from the upper-rear side of the apparatus.

Further, the printer 1 includes, as sheet transport paths, a first sheet transport path FR1 which is a sheet transport path facing the recording head 9 and through which a recording sheet can be transported in the first direction (+Y direction), which is a sheet transport direction when performing recording on the recording sheet, and in the second direction (−Y direction) opposite to the first direction, the reverse path RR through which the recording sheet is reversed, a second sheet transport path FR2 that guides the recording sheet subjected to the recording to the reverse path RR, and a third sheet transport path FR3 that is positioned vertically below the second sheet transport path FR2 and guides the recording sheet subjected to the recording to the reverse path RR, the third sheet transport path FR3 being different from the second sheet transport path FR2.

Further, according to the present embodiment, the first sheet transport path FR1 is a sheet transport path between the transport roller pair 15 and a first discharge roller pair 40. Further, the second sheet transport path FR2 is a sheet transport path that extends over a driven roller 14*d* and is positioned between the transport roller pair 15 and a driven roller 14*a*. Further, the third sheet transport path FR3 is a sheet transport path that extends over a reverse driving roller 44 and is positioned between a second discharge roller pair 46 and the driven roller 14*a*. Further, the reverse path RR is a sheet transport path between the driven roller 14*a* and a driven roller 14*c*. Further, in FIG. 2, a sheet transport path FR4 is a sheet transport path (fourth sheet transport path) between the driven roller 14*c* and the transport roller pair 15. Further, a sheet transport path FR5 is a sheet transport path (fifth sheet transport path) between the first discharge roller pair 40 and the second discharge roller pair 46.

In the sheet feeding path K1, the recording sheet is fed by a feeding roller 11. The feeding roller 11 is supported by a supporting member 12 that rocks about a rocking shaft 12*a* and the feeding roller 11 advances and retreats with respect to a recording sheet P housed in the first sheet cassette 51 in response to the rocking of the supporting member 12.

The same feeding mechanism (not illustrated) is provided in the second sheet cassette 52 (not illustrated in FIG. 2) provided under the first sheet cassette 51.

The reverse roller 21 has the largest diameter compared with other rollers and curves and reverses the recording sheet. The driven rollers 14*a*, 14*b*, 14*c*, and 14*d* are provided around the reverse roller 21. The recording sheet fed through the sheet feeding path K1 or K2 is transported to the transport roller pair 15 through the reverse path RR and the fourth sheet transporting path FR4.

The recording sheet fed through the sheet feeding path K3 is transported to the transport roller pair 15 through the fourth sheet transporting path FR4.

The recording sheet transported in the −Y direction through the second sheet transport path FR2 is transported to the transport roller pair 15 through the reverse path RR and the fourth sheet transporting path FR4.

Similarly, the recording sheet transported in the −Y direction through the third sheet transport path FR3 is transported to the transport roller pair 15 through the reverse path RR and the fourth sheet transporting path FR4.

The transport roller pair 15 includes a transport driving roller 16 that rotates and a transport driven roller 17 that is driven to rotate. The recording sheet transported to the transport roller pair 15 is nipped by the transport driving roller 16 and the transport driven roller 17, is transported to a region facing the recording head 9, that is, the region where recording is performed, and is subjected to recording.

A carriage 8 including the recording head 9 is guided by a carriage guide shaft 19 that extends in the X-axis direction and is reciprocated in the X-axis direction by a driving force from a carriage driving motor (not illustrated). The recording head 9 ejects ink to the recording sheet along with a movement operation of the carriage 8.

A supporting member 18 is provided at a position facing the recording head 9, and the recording sheet subjected to recording by the recording head 9 is supported by the supporting member 18.

The first discharge roller pair 40 that transports downstream the recording sheet subjected to recording is provided downstream of the supporting member 18. The first discharge roller pair 40 includes a first discharge driving roller 41 as a "first roller" that rotates and a first discharge driven roller 42 that is driven to rotate. The first discharge driving roller 41 is a rubber roller in the present embodiment, and the first discharge driven roller 42 is a spur in point-contact with the recording sheet in the present embodiment.

The first discharge roller pair 40 is the roller pair positioned first downstream of the recording head 9.

The second discharge roller pair 46 is provided downstream of the first discharge roller pair 40. The second discharge roller pair 46 includes a second discharge driving roller 47 as a "second roller" that rotates and a second discharge driven roller 48 that is driven to rotate.

A driven roller 49 is provided between the first discharge roller pair 40 and the second discharge roller pair 46 and suppresses a lift of the recording sheet.

The second discharge driving roller 47 is a rubber roller in the present embodiment, and the second discharge driven roller 48 and the driven roller 49 are spurs in point-contact with the recording sheet in the present embodiment.

A function of the second discharge roller pair 46 will be described in more detail later.

Hereinafter, the second sheet transport path FR2, the third sheet transport path FR3, and the reverse path RR will further be described.

When performing recording on a second surface of a recording sheet of which a first surface has been subjected to recording, the second surface being opposite to the first surface, the recording sheet subjected to recording is transported to the reverse path RR. Any of the second sheet transport path FR2 or the third sheet transport path FR3 can be selected as a sheet transport path at this time.

A length of the third sheet transport path FR3 is larger than a length of the second sheet transport path FR2. Therefore, a controller (not illustrated) of the printer 1 holds a threshold value of a sheet length, selects the third sheet transport path FR3 when the length of the recording sheet exceeds the threshold value, and selects the second sheet transport path FR2 when the length of the recording sheet is smaller than the threshold value. In other words, it is possible to deal with a long recording sheet by using the third sheet transport path FR3.

When using the second sheet transport path FR2, after the recording on the first surface is completed, the transport driving roller 16, the first discharge driving roller 41, and the second discharge driving roller 47 rotate in a reverse direction. By doing so, the recording sheet is transported in the −Y direction through the second sheet transport path FR2 and reaches the reverse path RR.

When using the third sheet transport path FR3, after the recording on the first surface is completed, the recording sheet is transported in the +Y direction until a rear end of the sheet reaches the driven roller 49, and then the second discharge driving roller 47 rotates in a reverse direction. A flap 39 that can rock about a rocking shaft 39*a* is provided upstream of the driven roller 49, and when transporting the recording sheet to the third sheet transport path FR3, an end portion of the flap 39 in the +Y direction is lifted upward (see FIG. 3). By doing so, the recording sheet is transported to the third sheet transport path FR3 and is transported to the reverse path RR. Further, the flap 39 is driven by a flap driving source (not illustrated) controlled by the controller (not illustrated).

A transport roller pair 43 is provided on the third sheet transport path FR3. The transport roller pair 43 includes a reverse driving roller 44 as a "third roller" that rotates and a reverse driven roller 45 that is driven to rotate. The reverse driving roller 44 is a rubber roller in the present embodiment, and the reverse driven roller 45 is a spur in point-contact with the recording sheet in the present embodiment.

From a viewpoint of applying a transport force to the recording sheet on the third sheet transport path FR3, the second discharge roller pair 46 functions as a first roller pair, and the transport roller pair 43 functions as a second roller pair.

The second discharge driving roller 47 included in the second discharge roller pair 46 can be driven in a normal rotation direction (clockwise direction in FIG. 2) to transport the recording sheet to the discharge port 10 through the first sheet transport path FR1 in the first direction and can be driven in a reverse rotation direction (counterclockwise direction in FIG. 2) opposite to the normal rotation direction. The second discharge driven roller 48 included in the second discharge roller pair 46 nips the recording sheet with the second discharge driving roller 47.

The second discharge roller pair 46 is positioned between the first sheet transport path FR1 and the discharge port 10, the recording sheet is discharged from the discharge port 10 by normal rotation of the second discharge driving roller 47, and the recording sheet is transported to the third sheet transport path FR3 by reverse rotation of the second discharge driving roller 47.

The medium transport device 4 includes the plurality of sheet transport paths and the plurality of rollers described above. The medium transport device 4 can be considered a device with no function, such as a function of the recording head 9, related to recording in the printer 1.

In the medium transport device 4 including the above-described sheet transport paths, the feeding roller 11 and the reverse roller 21 are driven by a motor (not illustrated). Further, in the medium transport device 4, the transport driving roller 16, the first discharge driving roller 41, the second discharge driving roller 47, and the reverse driving roller 44 can be driven according to two embodiments: a first drive embodiment and a second drive embodiment.

Figure 5:
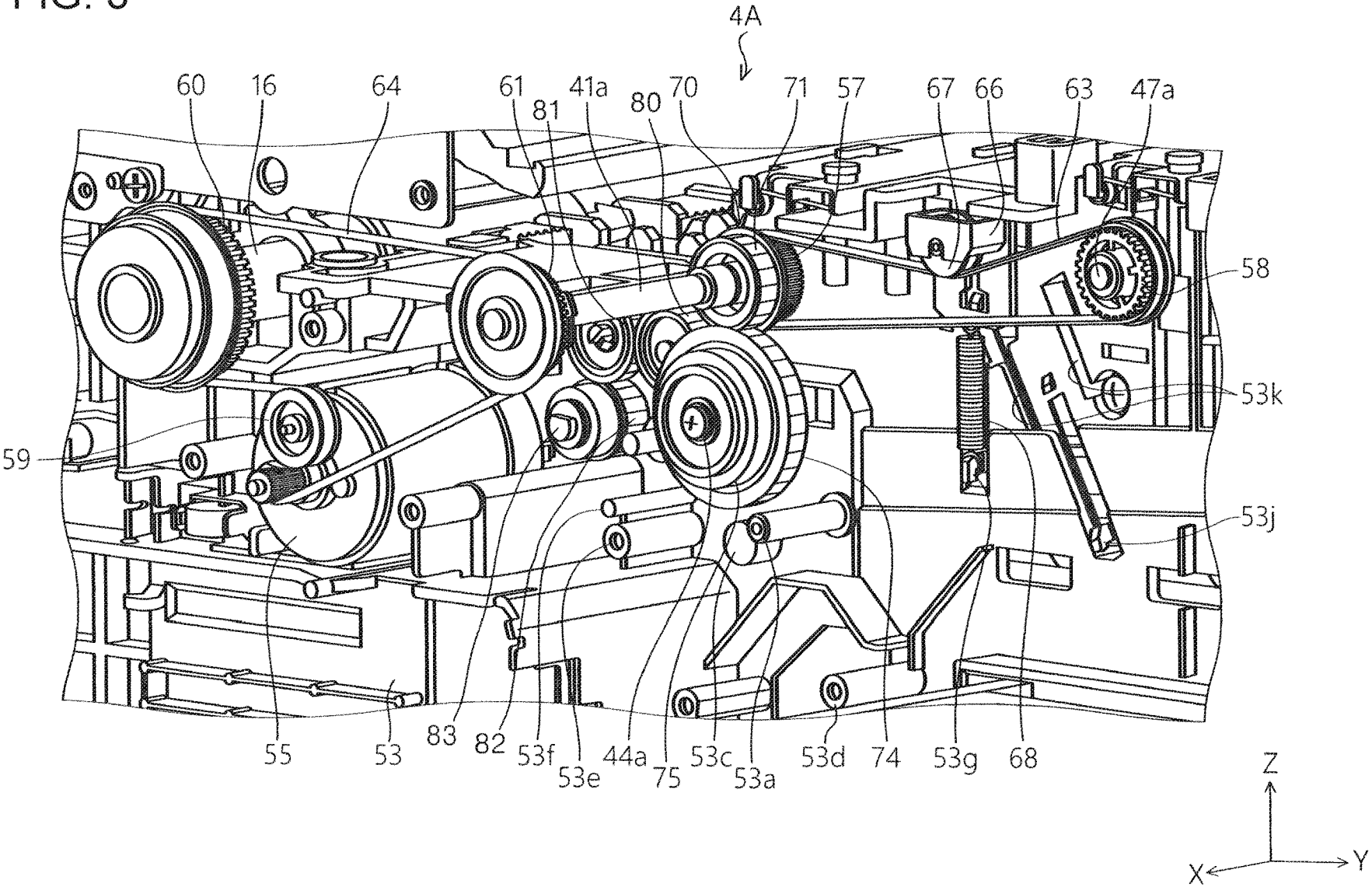
FIG. 5 is a perspective view of the medium transport device according to a first drive embodiment.

In the first drive embodiment, the transport driving roller 16, the first discharge driving roller 41, the second discharge driving roller 47, and the reverse driving roller 44 are driven by a first motor 55 (see FIG. 5).

Figure 7:
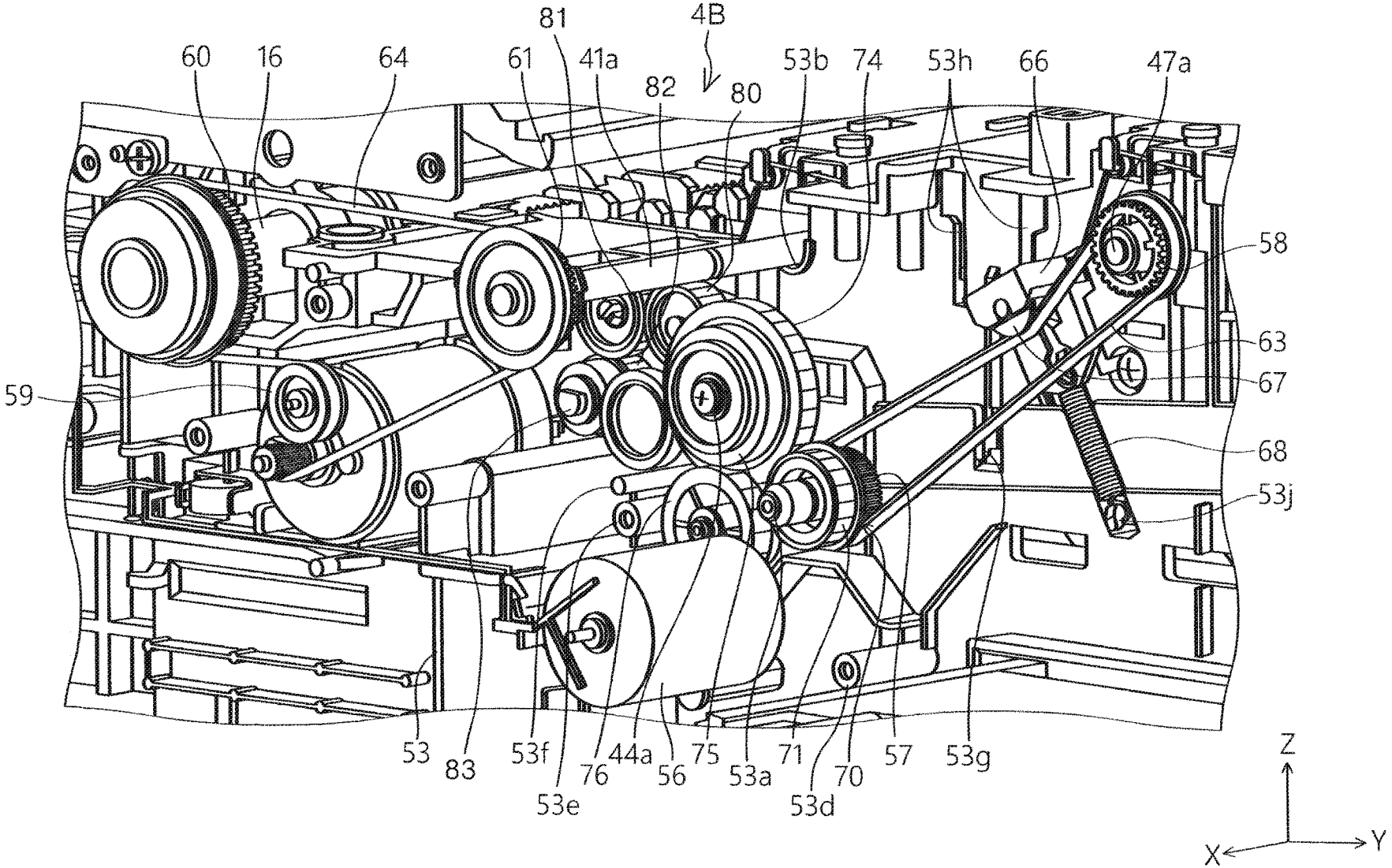
FIG. 7 is a perspective view of the medium transport device according to the second drive embodiment.

In the second drive embodiment, the transport driving roller 16 and the first discharge driving roller 41 are driven by the first motor 55 (see FIG. 7), and the second discharge driving roller 47 and the reverse driving roller 44 are driven by a second motor 56 (see FIG. 7). That is, the number of motors to be used differs between the first drive embodiment and the second drive embodiment.

For example, when a throughput-focused model is manufactured, the second drive embodiment of the medium transport device 4 is used and, when a cost-focused model is manufactured, the first drive embodiment of the medium transport device 4 is used, although the throughput-focused model and the cost-focused model have the same basic specification. As will be described in detail later, the printer 1 is configured so that the first and second drive embodiments can be implemented with the same frame configuration and little difference in components.

Figure 6:
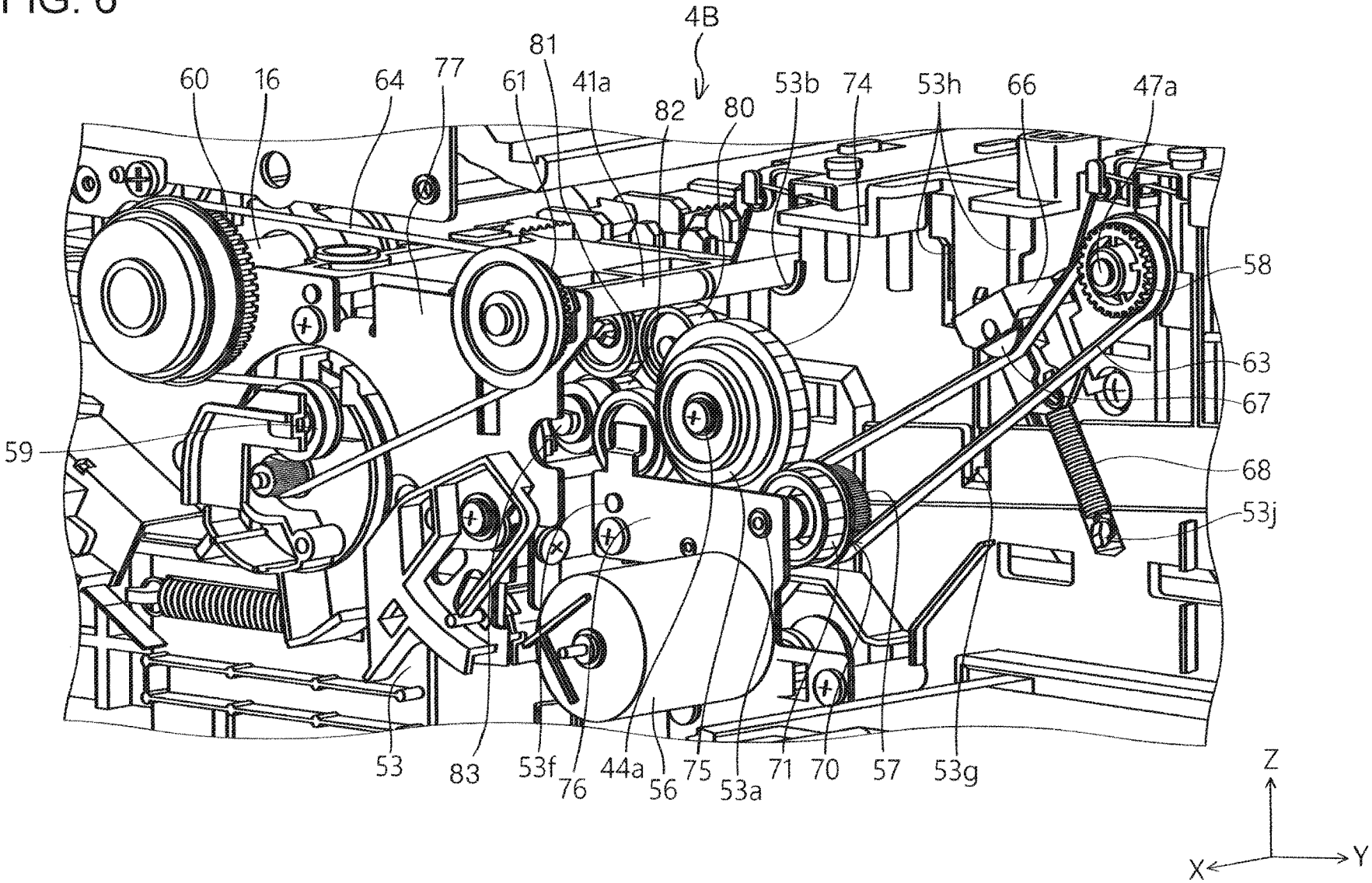
FIG. 6 is a perspective view of the medium transport device according to a second drive embodiment.
Figure 8:
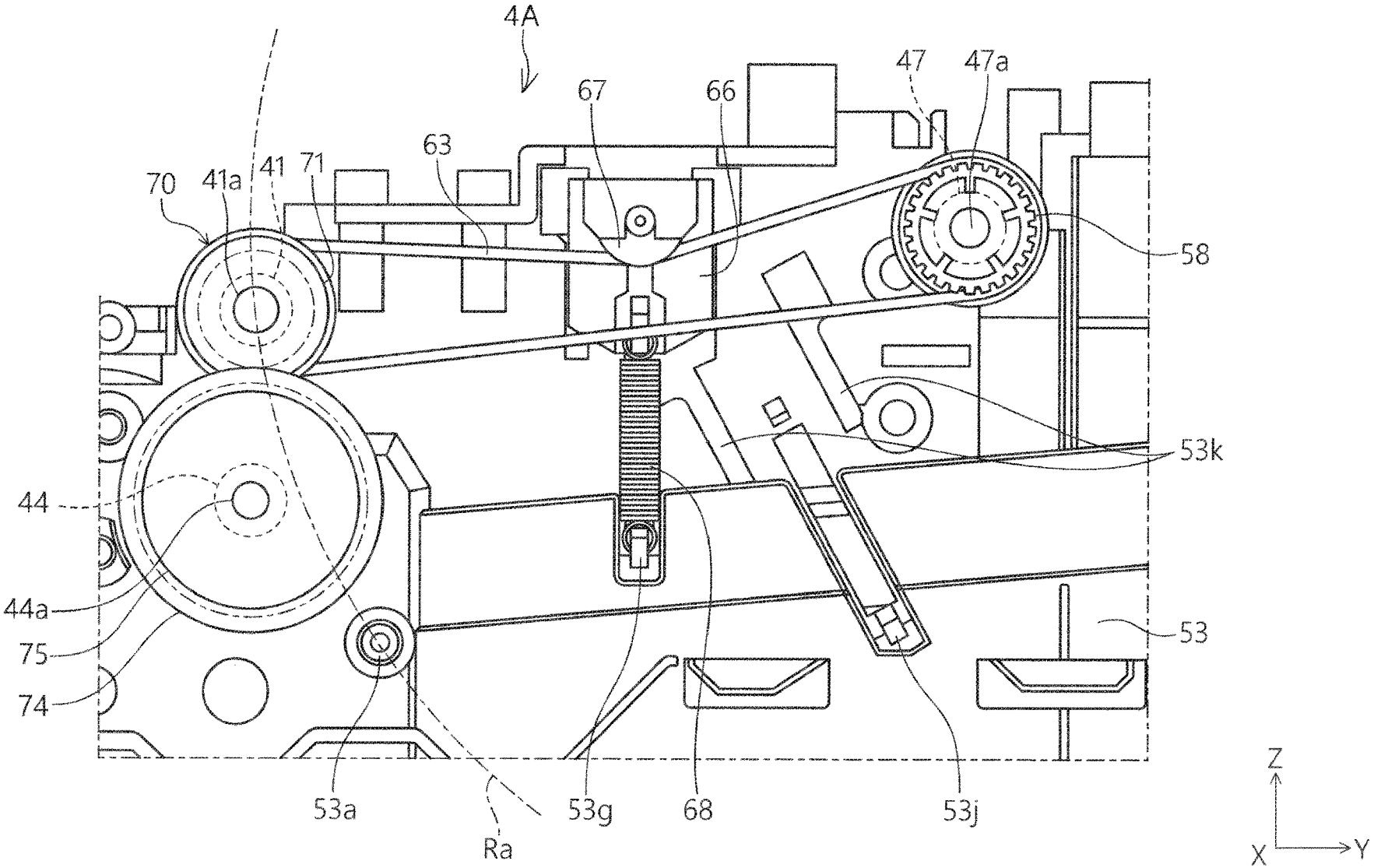
FIG. 8 is a plan view of the medium transport device according to the first drive embodiment.
Figure 9:
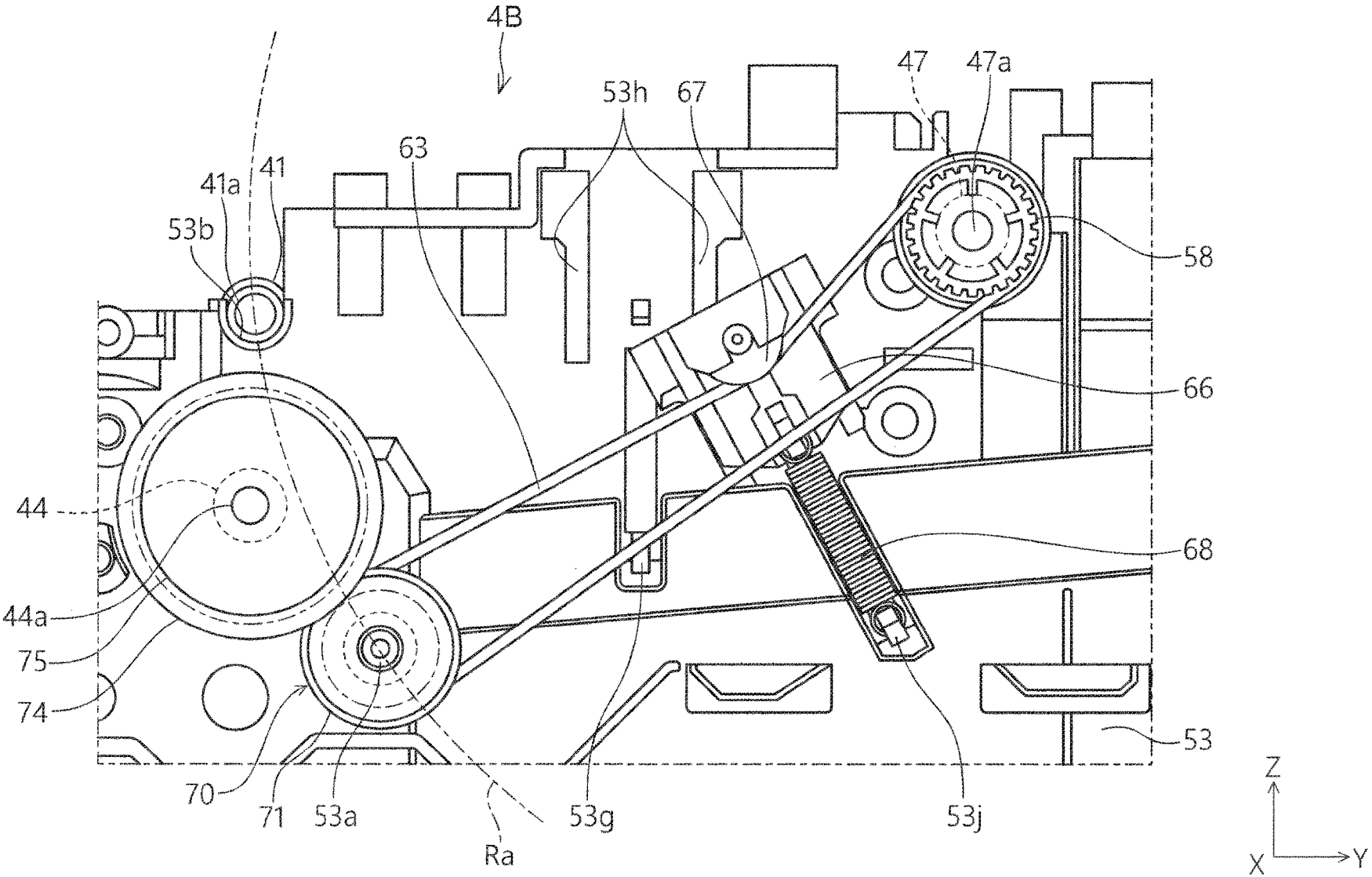
FIG. 9 is a plan view of the medium transport device according to the second drive embodiment.

Next, the configuration of the medium transport device 4 will further be described with reference to FIGS. 5 to 9. FIGS. 5 and 8 illustrate a configuration when the first drive embodiment is applied in the medium transport device, and FIGS. 6, 7, and 9 illustrate a configuration when the second drive embodiment is applied. A medium transport device 4A is a medium transport device according to the first drive embodiment, and a medium transport device 4B is a medium transport device according to the second drive embodiment. However, when there is no need to distinguish the medium transport device 4A according to the first drive embodiment and the medium transport device 4B according to the second drive embodiment, both will be simply referred to as the medium transport device 4.

The medium transport device 4 includes a side frame 53 provided on a side of the medium transport device 4 in the +X direction, and components such as a motor or a gear is attached to the side frame 53. Further, the medium transport device 4 further includes a side frame (not illustrated) provided on a side of the medium transport device 4 in the −X direction, and a rotation shaft of a roller is supported by the side frame and the side frame 53 as necessary.

In FIG. 5, the first motor 55 is provided on the side frame 53, and in the medium transport device 4, rotational torque is transmitted from the first motor 55 to the transport driving roller 16 (see FIG. 2) and the first discharge driving roller 41 (see FIG. 2) through a second belt 64 according to both of the first drive embodiment and the second drive embodiment. In FIG. 5, a fourth pulley 60 is provided on a shaft end of the transport driving roller 16, and a fifth pulley 61 is provided on a shaft end of the rotation shaft 41*a* of the first discharge driving roller 41. Further, a third pulley 59 applies tension to the second belt 64.

In FIG. 5, a rotation shaft 44*a* is provided, and a gear 74 is a gear as a "first rotor" and a "third roller driving gear". The gear 74 is a gear that rotates around the rotation shaft

44*a*. Rotational torque is transmitted from the gear 74 to a gear 80 through a one-way clutch 75. The gear 80 meshes with a gear 81, and the gear 81 meshes with a gear 82. The gear 82 is provided on a shaft end of a rotation shaft 83. The rotation shaft 83 is a rotation shaft of the reverse driving roller 44 (see FIG. 2). That is, rotational torque is transmitted from the gear 74 to the reverse driving roller 44 through the one-way clutch 75.

The one-way clutch 75 is a clutch for transmitting rotational torque in a certain direction to the gear 80, regardless of the rotation direction of the gear 74. Therefore, the reverse driving roller 44 (see FIG. 2) always rotates in a rotation direction (counterclockwise direction in FIG. 2) to transport the recording sheet in the −Y direction.

On the other hand, the transport driving roller 16 and the first discharge driving roller 41 rotate in a rotation direction (clockwise direction in FIG. 2) to transport the recording sheet in the +Y direction by normal rotation of the first motor 55, and rotate in a rotation direction (counterclockwise direction in FIG. 2) to transport the recording sheet in the −Y direction by reverse rotation of the first motor 55.

A rotation shaft 47*a* is a rotation shaft of the second discharge driving roller 47 (see FIG. 2), and a second pulley 58 as a "second rotor" is provided on a shaft end of the rotation shaft 47*a*. A first belt 63 is wound on the second pulley 58, and the second discharge driving roller 47 is driven by the first belt 63. Further, a driving source of the first belt 63 to be described later differs between the first drive embodiment and the second drive embodiment.

A driven pulley 67 is a driven pulley as a "tension applying member", and the driven pulley 67 is supported by a slider 66. The slider 66 is provided so as to be displaceable in a direction intersecting a direction in which the first belt 63 extends and is pressed by a tension spring 68 as a pressing member in a direction to push the driven pulley 67 against the first belt 63. In this way, tension is applied to the first belt 63.

Next, a characteristic configuration of the first drive embodiment will be described. As illustrated in FIG. 5, a rotor 70 as a "third rotor" is provided on the rotation shaft 41*a* of the first discharge driving roller 41. In the first drive embodiment, the rotation shaft 41*a* functions as a first shaft to which the rotor 70 is attached. Further, the shaft end of the rotation shaft 41*a* is supported by a supporting frame 77 (see FIG. 6). In FIG. 5, the supporting frame 77 is not illustrated. Further, a recess portion 53*b* for the rotation shaft 41*a* to pass through in the X-axis direction is formed in the side frame 53. In the present embodiment, the recess portion 53*b* does not function as a bearing that holds the rotation shaft 41*a*. However, the recess portion 53*b* may be configured to function as a bearing.

The rotor 70 provided on the rotation shaft 41*a* is formed by integrating a first pulley 57 and a gear 71 as a "first gear" with each other. The gear 71 meshes with the gear 74. Therefore, rotational torque of the motor 55 is transmitted from the rotation shaft 41*a* to the gear 74, and the reverse driving roller 44 (see FIG. 2) rotates.

The above-described first belt 63 is wound on the first pulley 57, and the rotational torque of the motor 55 is transmitted to the second discharge driving roller 47 through the first belt 63. Further, in the first drive embodiment, the slider 66 supporting the driven pulley 67 that applies tension to the first belt 63 is guided by a first guide groove 53*h* (see FIG. 6) formed in the side frame 53 and is displaced in the direction intersecting the direction in which the first belt 63 extends. In the first drive embodiment, the tension spring 68 is hooked to a first spring hook portion 53*g* formed on the side frame 53 and to the slider 66.

In this way, in the first drive embodiment, the transport driving roller 16 is driven by the first motor 55, the second discharge driving roller 47 and the reverse driving roller 44 are driven by the first motor 55 through the rotation shaft 41*a* of the first discharge driving roller 41 and the gear 71. As a result, it is possible to reduce parts costs of the apparatus.

Next, a characteristic configuration of the second drive embodiment will be described. As illustrated in FIGS. 6 and 7, in the second drive embodiment, the rotor 70 constituted by the first pulley 57 and the gear 71 described above is attached to a shaft portion 53*a* as a second shaft, unlike the first drive embodiment described above. In the present embodiment, the shaft portion 53*a* is integrated with the side frame 53 by using a resin material.

Further, fixing portions 53*d* and 53*e* (see FIG. 5) are integrated with the side frame 53, and a motor fixing plate 76 is fixed to the fixing portions 53*d* and 53*e* by using screws as illustrated in FIG. 6. Further, FIG. 7 is a view illustrating a state in which the motor fixing plate 76 is removed in the state illustrated in FIG. 6.

The second motor 56 is fixed to the motor fixing plate 76. The second motor 56 transmits rotational torque to the gear 71 through a gear 76 (see FIG. 7). Further, the gear 71 meshes with the gear 74. Accordingly, the rotational torque of the second motor 56 is transmitted to the reverse driving roller 44 (FIG. 2). The gear 76 is supported by a shaft portion 53*c* (see FIG. 5) integrated with the side frame 53.

When the motor fixing plate 76 is fixed to the side frame 53, a shaft end of the shaft portion 53*a* is inserted into a hole of the motor fixing plate 76 as illustrated in FIG. 6, and is supported by the motor fixing plate 76. As a result, displacement of the shaft portion 53*a* is suppressed.

Further, a positioning shaft 53*f* is formed on the side frame 53 (see FIG. 5). When the motor fixing plate 76 is fixed to the side frame 53, the positioning shaft 53*f* is inserted into a hole of the side frame 53 (see FIG. 6) to restrict a position of the side frame 53.

Further, in the second drive embodiment, unlike the first drive embodiment described above, the slider 66 supporting the driven pulley 67 is guided by a second guide groove 53*k* (see FIG. 5) formed in the side frame 53 and is displaced in a direction intersecting a direction in which the first belt 63 extends. In addition, the tension spring 68 is hooked between a second spring hook portion 53*j* formed on the side frame 53, and the slider 66, and is pressed in a direction to push the driven pulley 67 against the first belt 63.

In this way, in the second drive embodiment, the transport driving roller 16 and the first discharge driving roller 41 are driven by the first motor 55, and the second discharge driving roller 47 and the reverse driving roller 44 are driven by the second motor 56 through the gear 71. As a result, a degree of freedom in control is increased.

Figure 3:
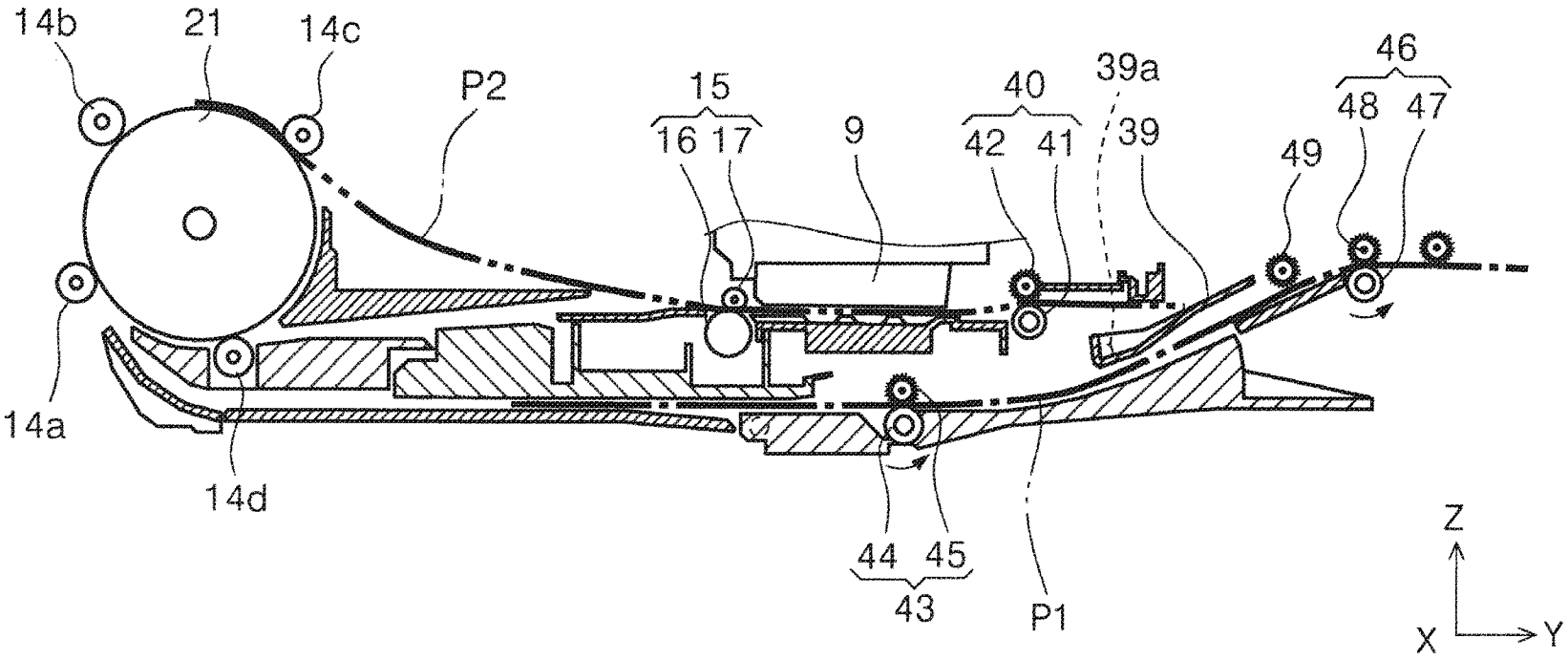
FIG. 3 is a side sectional view illustrating part of the sheet transport path of the printer.
Figure 4:
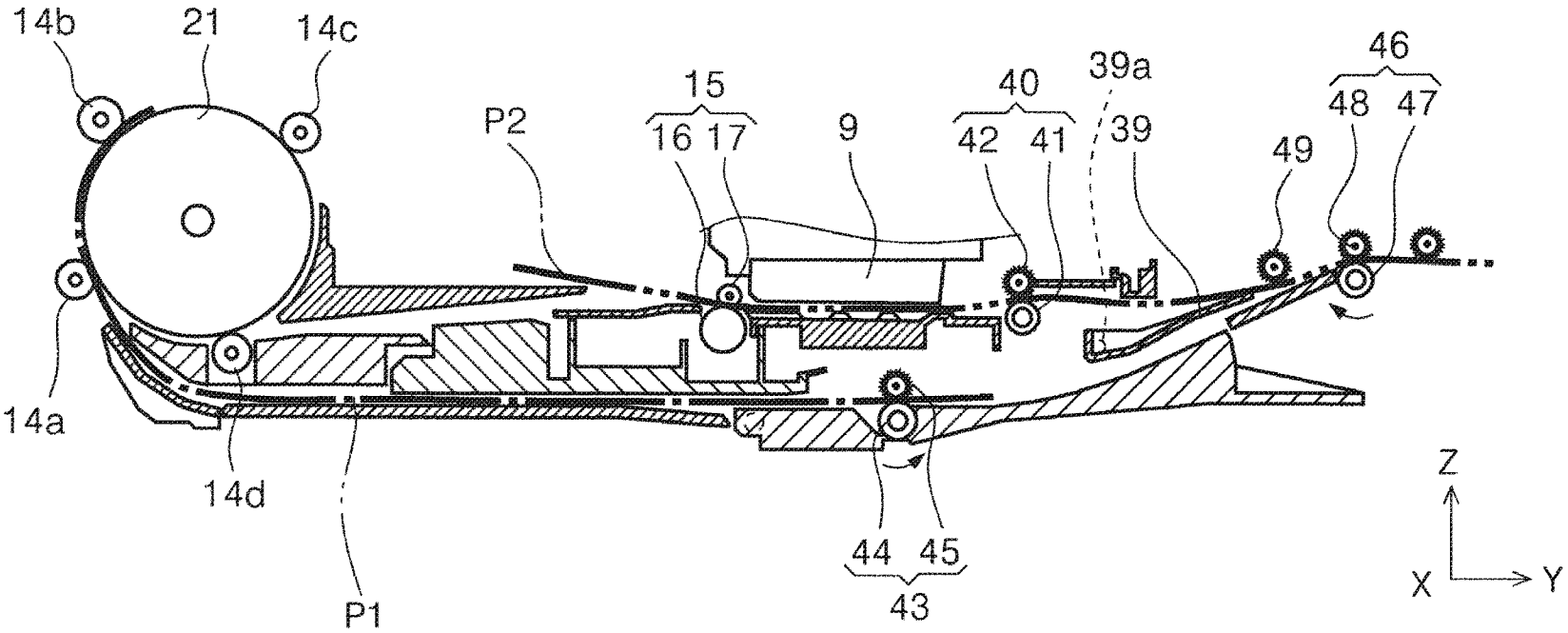
FIG. 4 is a side sectional view illustrating part of the sheet transport path of the printer.

For example, in FIGS. 3 and 4, a line with alternating long and short dashes P1 indicates a preceding sheet transported to the third transport path FR3 to perform recording on a second surface after recording is performed on a first surface. Further, a line with alternating long and two short dashes P2 indicates a following sheet that is fed subsequent to the preceding sheet P1 and is currently subjected to recording.

In a state illustrated in FIG. 3, the second discharge driving roller 47 rotates in a counterclockwise direction in FIG. 3 by reverse rotation of the second motor 56 (see FIG. 7) so as to transport the preceding sheet P1 to the third transport path FR3.

However, when sheet transportation proceeds in this state, a leading edge of the following sheet P2 reaches the second discharge driving roller 47, and thus the second motor 56 is switched from the reverse rotation to normal rotation. As a result, the second discharge driving roller 47 rotates in a clockwise direction as illustrated in FIG. 4.

By applying the second drive embodiment as described above, it is possible to simultaneously perform the operation of transporting the preceding sheet P1 in the third transport path FR3 and the operation of performing recording on the following sheet P2. In other words, a degree of freedom in control is increased.

As described above, the rotor 70 is attached to the rotation shaft 41*a* as the first shaft in the first drive embodiment, and is attached to the shaft portion 53*a* as the second shaft in the second drive embodiment. That is, a driving force transmission configuration can vary between when using the rotation shaft 41*a* and when using the shaft portion 53*a*.

Further, as illustrated in FIGS. 8 and 9, a shaft center of the rotation shaft 41*a* and a shaft center of the shaft portion 53*a* are positioned on a circular arc Ra, the center of which is a rotation center of the second discharge driving roller 47 as the second roller. As a result, a distance between the rotation center of the second discharge driving roller 47 and the rotation shaft 41*a*, and a distance between the rotation center of the second discharge driving roller 47 and the shaft portion 53*a* are kept constant. In addition, both an interval between the rotation shaft 41*a* and the gear 74 and an interval between the shaft portion 53*a* and the gear 74 are set to a first interval.

Accordingly, the same specification of the rotor 70 and the first belt 63 can be used in both when transmitting a driving force between the gear 74 and the second discharge driving roller 47 by using the rotation shaft 41*a*, that is, when applying the first drive embodiment, and when transmitting a driving force between the gear 74 and the second discharge driving roller 47 by using the shaft portion 53*a*, that is, when applying the second drive embodiment. As a result, the same component configuration for the driving force transmission mechanism using a belt, a gear, or the like can be used in the first drive embodiment and the second drive embodiment, such that it is possible to effectively suppress an increase in costs when developing models with different specifications.

Further, in the medium transport device 4, the first guide groove 53*h* (see FIG. 9) that guides the slider 66, and the second guide groove 53*k* (see FIG. 8) that extends in a direction intersecting a direction in which the first guide groove 53*h* extends and that guides the slider 66 are provided in the side frame 53.

Therefore, it is possible to apply tension to the first belt 63 in an appropriate direction even when the same side frame 53 is used in the first drive embodiment and the second drive embodiment.

Further, in the present embodiment, the shaft portion 53*a* as the second shaft is integrated with the side frame 53. Therefore, it is possible to reduce costs of the apparatus. Further, in the present embodiment, the rotation shaft 41*a* as the first shaft is a member separate from the side frame 53. However, a shaft portion similar to the shaft portion 53*a* may be integrated with the side frame 53 to function as the first shaft. In addition, in the present embodiment, the shaft portion 53*a* as the second shaft is integrated with the side frame 53. However, the shaft portion 53*a* may be configured as a member separate from the side frame 53.

It goes without saying that the present disclosure is not limited to the embodiments described above, that a variety of modifications is possible within the scope of the present disclosure described in the claims, and that the modifications also fall within the scope of the present disclosure.

For example, in the above-described embodiment, transmitting of a driving force using a gear may be replaced with transmitting of a driving force using a pulley and a belt, and it is a matter of course that transmitting of a driving force using a pulley and a belt may be replaced with transmitting of a driving force using a gear.

What is claimed is:

1. A medium transport device comprising:

a first roller that applies a transporting force to a medium;

a second roller that applies a transporting force to the medium transported from the first roller;

a third roller that applies a transporting force to the medium transported from the second roller;

a first rotor that transmits rotational torque to the third roller;

a first shaft that is provided away from the first rotor at a first interval; and a second shaft that is provided away from the first rotor at the first interval and at a position different from a position of the first shaft, wherein a shaft center of the first shaft and a shaft center of the second shaft are positioned on a circular arc, a center of which is a rotation center of the second roller.

2. The medium transport device according to claim 1, further comprising:

a second rotor that is provided on a rotation shaft of the second roller and applies rotational torque to the second roller;

a belt that is wound on a third rotor provided on the first shaft or the second shaft and wound on the second rotor;

a tension applying member that applies tension to the belt;

a slider that supports the tension applying member and is configured to slide in a direction to advance and retreat with respect to the belt; and a pressing member that applies a pressing force to the slider, wherein a first guide groove that guides the slider, and a second guide groove that extends in a direction intersecting a direction in which the first guide groove extends and that guides the slider are provided in a frame supporting the rotation shaft of the second roller.

3. The medium transport device according to claim 2, wherein at least one of the first shaft or the second shaft is integrated with the frame.

4. A recording apparatus comprising:

a recording unit that performs recording on a medium; and the medium transport device according to claim 1.

5. A recording apparatus comprising:

a recording unit that performs recording on a medium; and the medium transport device according to claim 2, wherein the medium transport device includes:

a first medium transport path which is a medium transport path facing the recording unit and is configured to transport the medium in a first direction which is a medium transport direction when performing the recording on the medium and in a second direction opposite to the first direction;

a reverse path configured to reverse the medium;

a second medium transport path configured to guide, to the reverse path, the medium subjected to the recording by the recording unit; and a third medium transport path which is positioned vertically below the second medium transport path, guides, to the reverse path, the medium subjected to the recording by the recording unit, and differs from the second medium transport path, the first roller is provided downstream of the recording unit on the first medium transport path and transports the medium in the first direction, the second roller is positioned downstream of the first roller in the first direction and is configured to rotate in a normal rotation direction to transport the medium transported in the first direction to a discharge port and in a reverse rotation direction opposite to the normal rotation direction, the medium being discharged from the discharge port by normal rotation of the second roller and the medium being transported to the third medium transport path by reverse rotation of the second roller, and the third roller is provided on the third medium transport path and is configured to rotate only in a normal rotation direction to transport the medium to the reverse path.

6. The recording apparatus according to claim 5, wherein the first shaft is a rotation shaft of the first roller, the third rotor is provided on the first shaft, a first gear that meshes with a third roller driving gear as the first rotor is integrated with the third rotor, and the second roller and the third roller are driven by a first motor through the rotation shaft of the first roller and the first gear.

7. The recording apparatus according to claim 5, wherein the first shaft is a rotation shaft of the first roller, the third rotor is provided on the second shaft, a first gear that meshes with a third roller driving gear as the first rotor is integrated with the third rotor, the first roller is driven by a first motor, and the second roller and the third roller are driven by a second motor through the first gear.

8. The recording apparatus according to claim 7, further comprising a motor attaching member to which the second motor is attached, wherein a shaft end of the second shaft is supported by the motor attaching member in a state in which the motor attaching member is fixed to the frame.

* * * * *